United States Patent [19]

Kagler, Jr.

[11] 3,984,991

[45] Oct. 12, 1976

[54] ANCHOR AND METHOD OF SETTING ANCHOR

[75] Inventor: Edmond Kagler, Jr., Houston, Tex.

[73] Assignee: A-Z International Tool Company, Houston, Tex.

[22] Filed: Mar. 17, 1975

[21] Appl. No.: 559,054

[52] U.S. Cl. ..... 61/99; 175/7; 61/53.68

[51] Int. Cl.[2] ..... B63B 21/00; E02D 5/54; E21B 7/12

[58] Field of Search ..... 61/46, 46.5, 53.52, 61/53.58, 53.68; 175/7, 171

[56] References Cited

UNITED STATES PATENTS

| | | | |
|---|---|---|---|
| 2,891,770 | 6/1959 | Bauer et al. | 175/7 |
| 3,131,768 | 5/1964 | Chancellor et al. | 61/53.58 X |
| 3,525,224 | 8/1970 | Bardgette | 61/46 |
| 3,621,910 | 11/1971 | Sanford et al. | 61/53.68 |

*Primary Examiner*—Paul R. Gilliam
*Assistant Examiner*—David H. Corbin
*Attorney, Agent, or Firm*—Vinson, Elkins, Searls, Connally & Smith

[57] ABSTRACT

An anchor which includes a tubular body, a top closure and a bottom closure secured to opposite ends of said tubular body, a plurality of drilling cutters mounted on the bottom closure, a neck having an external groove therein secured to the top closure, an opening in both the top and bottom closures, means for coacting with a drill string extending into said closures for sealing to maintain the interior of said body substantially free of water when submerged, a ratchet collar adaped to coact with a mating ratchet collar of the drill string for rotating the anchor to cause it to drill into the bottom of a body of water, a swivel adapted to be lowered onto the neck of the top closure when it has been set, latching dogs engaging in the external groove to secure the swivel to the body, and floatation means for signaling the surface that the swivel is set. The method of setting an anchor assembly including the steps of lowering an anchor body having cutters on the bottom thereof on the end of a drill string extending through the top of the anchor body and into the bottom for circulation of drilling fluid onto the face of the formation being drilled, the drill string being sealed to the anchor body to prevent entry of water therein, rotating the drill string and anchor body to drill the hole and lower the anchor body into the hole simultaneously, cementing around the exterior of the anchor body, then cementing the interior of the anchor body, lowering a swivel onto the top of the anchor body and signaling the seating of the swivel. This abstract is neither intended to define the invention of the application which, of course, is measured by the claims, nor is it intended to be limiting as to the scope of the invention in any way.

12 Claims, 8 Drawing Figures

ANCHOR AND METHOD OF SETTING ANCHOR

BACKGROUND OF THE INVENTION

Marine anchors have long been used and with recent increase in marine oil drilling, marine anchors have been provided with cutters on their underside so that they can drill into the bottom to form their own bore and then be cemented in position. An example of such anchors is shown in U.S. letters Pat. No. 3,621,910, issued Nov. 23, 1971.

With deeper drilling and the use of larger drilling platforms and larger floating oil storage structures, the anchor loadings have become correspondingly larger requiring the use of larger anchors. Such large anchors are very heavy and difficult to handle. Also, in the use of such anchors the connection to the anchor and the cable or other anchor line is preferably recovered when the floating structure which has been anchored is to be moved.

SUMMARY

The present invention relates to an improved marine anchor assembly and an improved method of setting a marine anchor.

An object of the present invention is to provide an improved marine anchor having substantial size and potential weight for anchoring which is readily and easily handled during setting.

A further object of the present invention is to provide an improved marine anchor having a swivel connection for an anchor line which does not interfere with the drilling of the anchor bore hole.

Another object of the present invention is to provide an improved method of setting a marine anchor so that a substantially larger and heavier anchor may be handled easily.

Still another object is to provide an improved method of setting a marine anchor allowing separate setting of the anchor swivel with surface indication thereof.

The improved marine anchor of the present invention is provided with structure allowing circulation of drilling fluid therethrough without flooding the interior of the anchor so that it is much easier to handle in the water because of its normal buoyancy. The drilling weight of the anchor is further reduced by its separate swivel connection which may be lowered and installed on the set anchor. Setting of the swivel provides a surface indication that it has locked in place. Also, wire lines used for lowering the swivel are recoverable once the swivel is set.

The improved method of setting a marine anchor includes the steps of sealing the drill string within the anchor before the anchor is lowered into the water to assure that it does not become flooded whereby as it is lowered its handling weight is reduced by its buoyancy. Also, the improved method includes the steps of lowering the swivel with the anchor line attached thereto into position on the set and providing a positive indication of the surface that the swivel has locked to the anchor.

BRIEF DESCRIPTION OF THE DRAWINGS

The aforementioned objects and other objects and advantages are hereinafter set forth and explained in the following description with reference to the drawings wherein.

DESCRIPTION OF THE PREFERRED EMBODIMENT

Figure 1:
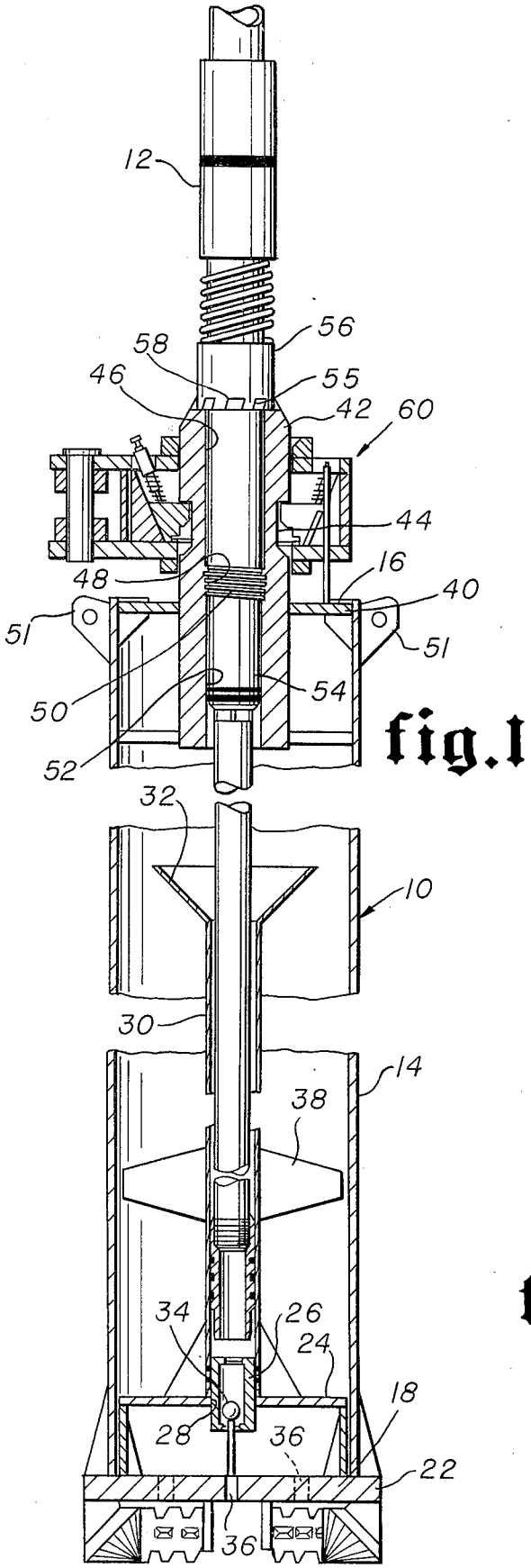
FIG. 1 is a longitudinal sectional view of the improved anchor of the present invention with the drill string and swivel assembly connected to the anchor.

As shown in FIG. 1, the improved marine anchor assembly 10 of the present invention has the lower end of the drill string 12 connected therein. The anchor assembly 10 includes the tubular shell 14, the top closure 16 and the bottom closure 18 to which the roller cutters 20 are secured.

The bottom closure 18 includes the plate 22 which is secured to the shell 14 as by welding, the box 24 which is secured to plate 22 within shell 14 and the valve cage 26 which is secured in the central aperture 28 in box 24. The landing tube 30 is secured to, surrounds and extends upwardly from valve cage 26 and terminates at its upper end in the frusto-conical mouth 32. The mouth 32 is adapted to receive and direct the lower end of the drill string 12 into the lower portion of landing tube 30 as hereinafter explained. Since the drill string 12 is positioned within the lower end of landing tube 30 during drilling, the cage 26 is open at both ends to provide flow of drilling fluid into the interior of box 24. Ball 34 within cage 26 is provided to prevent reverse flow unless reverse circulation is to be used, in which event the ball 34 is omitted. The drilling fluid is discharged through the openings 36 extending through plate 22 to direct the flow of drilling fluid against the formation being cut and to remove particles and broken pieces of formation. The fins 38 are secured to landing tube 30 to support the tube 30 within shell 14.

The top closure 16 includes the plate 40 which is secured to the top of shell 14 as by welding and is suitably braced as shown. The drilling neck 42 which extends through the central portion of plate 40 is suitably secured thereto. The drilling neck 42 has an exterior groove 44 which coacts with the swivel as hereinafter explained and an internal bore 46 which is threaded at 48. The threads 48 receive the threads 50 on the exterior of the drill string 12 to secure the drill string 12 in position in the marine anchor assembly 10. The lifting lugs 51 secured to top closure 16 are used for handling of the anchor assembly. The innermost portion of bore 46 has a reduced diameter and a relatively smooth cylindrical surface 52 for sealing of the packing 54 on the drill string 12.

The rotation of the assembly 10 is accomplished by the engagement of the teeth 55 on the spring loaded drive collar 56 with the teeth 58 on the upper end of drilling neck 42. The teeth 58 are sloped as shown to allow reverse rotation (from drilling rotation) to cam the collar 56 out of engagement with the teeth to allow drill string 12 to be released from the marine anchor assembly 10 when drilling is complete.

Figure 2:
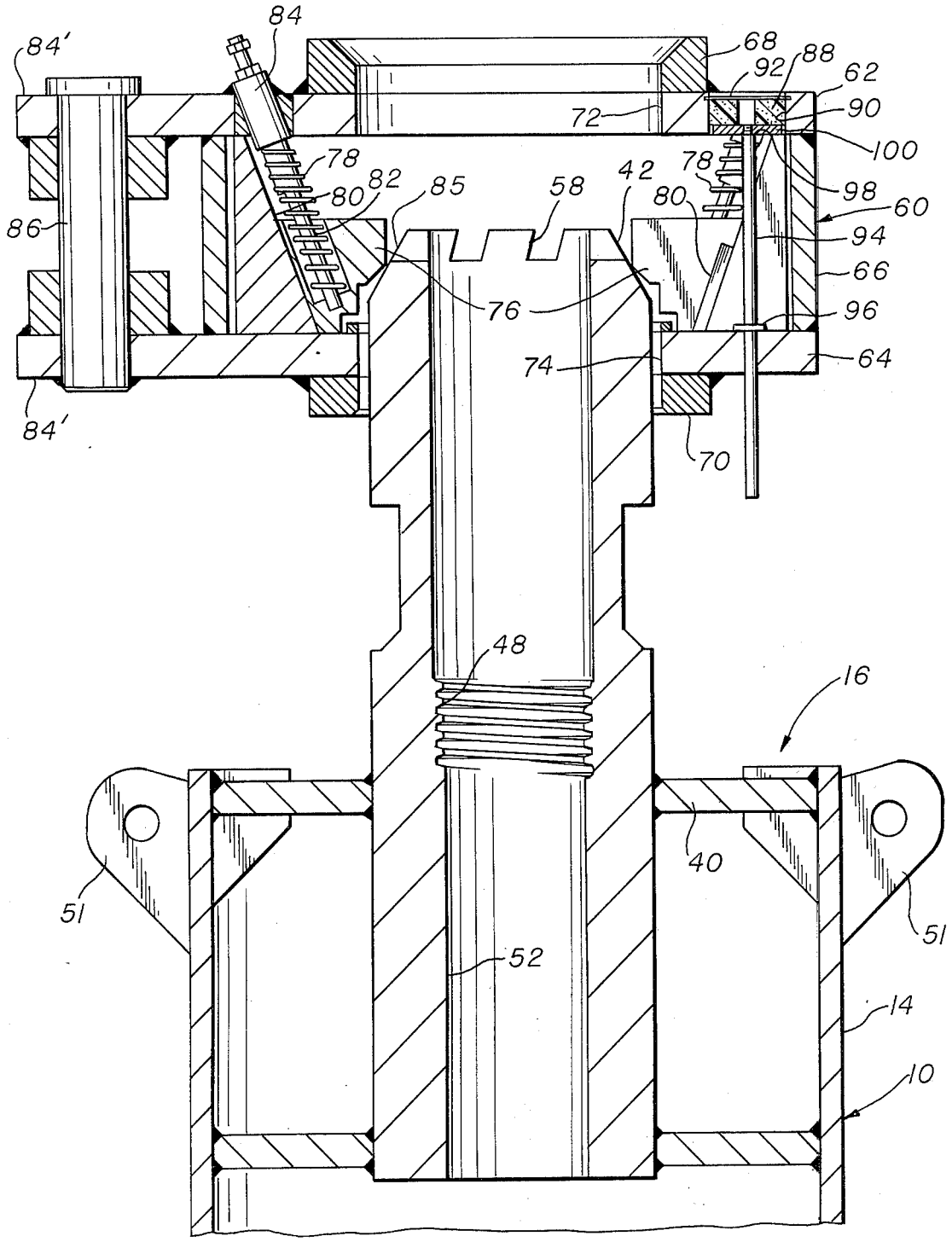
FIG. 2 is a sectional view of the swivel.

When the marine anchor assembly 10 is cemented in place in the bottom formation, the swivel assembly 60 is connected thereto to provide the connection for the anchor line. The swivel assembly 60 as shown in FIG. 2 includes the upper and lower plates 62 and 64 which are suitably secured to the ends of tubular ring 66. The upper and lower reinforcing rings 68 and 70 are secured around the central openings 72 and 74 of the plates 62 and 64.

When swivel assembly 60 is positioned on the drilling neck 42 of the marine anchor assembly 10, a means is provided to assure that it does not accidentally disengage therefrom while allowing the swivel assembly 60 to rotate around the drilling neck 42. Such means functions as a latch and includes the latch dogs 76 which are biased by springs 78 downward in the latch dog slides or cams 80 toward their latch position of engagement in the groove 44. The pin 82 coacts in sleeve 84 to retain the dogs 76 on their respective cams 80 as they move upwardly thereon when the swivel assembly 60 is moved into drilling neck 42. Preferably, eight of such latching means would be used in the swivel assembly 60. The plates 62 and 64 have ears 84 which extend beyond ring 66 at one side and anchor line pin 86 is secured therebetween. As shown in FIG. 2 the swivel assembly is above its latched position and the latch dogs 76 are retracting by engagement with the external taper 85 on the drill neck 42.

As hereinbefore mentioned, it is desired to provide an indication at the surface when the swivel assembly 60 is locked in position on the anchor assembly 10. Such indicating means are provided by the buoyant markers 88 which are held in the recess 90 in plate 62 by the locking ring 92. The markers 88 are released by the push rods 94 which extend through the plate 64 and have a flange 96 which engages the upper surface of plate 64. The upper end of rods 94 are reduced to provide the shoulders 98 engaging under the marker support ring 100. A plurality (preferably four) of such markers are used to assure that all of the latch dogs 76 have engaged in groove 44, latching swivel assembly 60 to anchor assembly 10. The push rods 94 are of a length to engage plate 40 and disengage the locking rings 92 when the swivel assembly 60 is locked on drilling neck 42.

Figure 3:
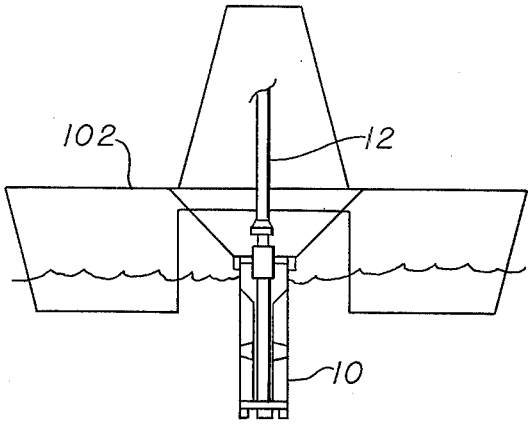
FIG. 3 is a schematic view of an anchor setting vessel with the anchor connected to the end of the drill pipe and suspended below the rotary table.

In the improved method of setting the anchor is started by setting the lower end of the drill string 12 within the anchor assembly 10 and then suspending the assembly below the turntable on the drilling vessel 102 as shown in FIG. 3 so that the remainder of the drill string 12 can be connected to the lower end. The drill string 12 is first connected into the anchor assembly 10 so that both ends thereof are sealed and thus preventing entry of water into the anchor assembly 10 during lowering into the water. The buoyancy of anchor assembly 10 therefor greatly reduce its handling weight in water.

Figure 4:
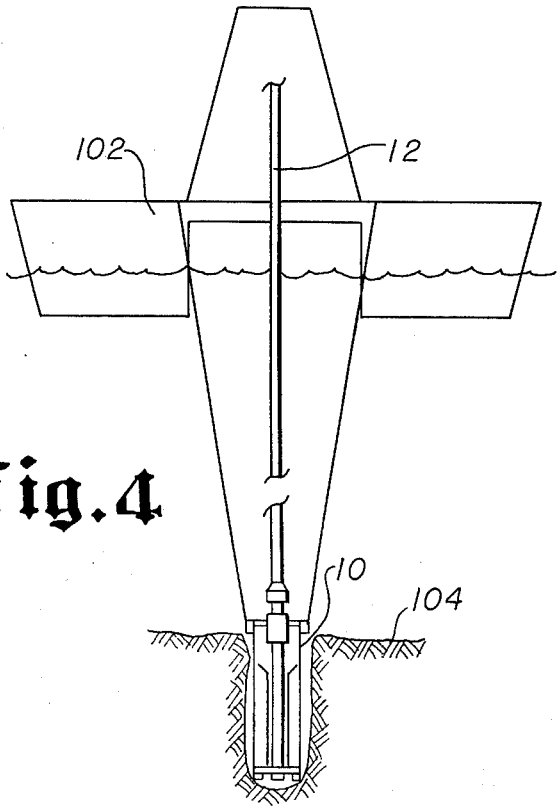
FIG. 4 is a schematic view of the drilling of the bore hole with the anchor.

As shwon in FIG. 4, the anchor assembly 10 is rotated by rotating the drill string 12 on the drilling vessel 102. With the rotation of the anchor assembly 10 in contact with the bottom 104, the cutters 20 cut therein and the circulation of fluids causes the cuttings to be carried out of the bore 106 into which the anchor assembly 10 is lowered.

When the drilling is completed, the drill string 12 is rotated in the opposite direction to cause collar teeth 55 to disengage from neck teeth 58 and the drill string threads 50 to disengage from the neck threads 48. Thereafter drill string 12 is raised a short distance to disengage the drill string packing seals 54 from the surface 52 in neck 42. This allows liquids to flow into the interior of anchor assembly 10.

Figure 5:
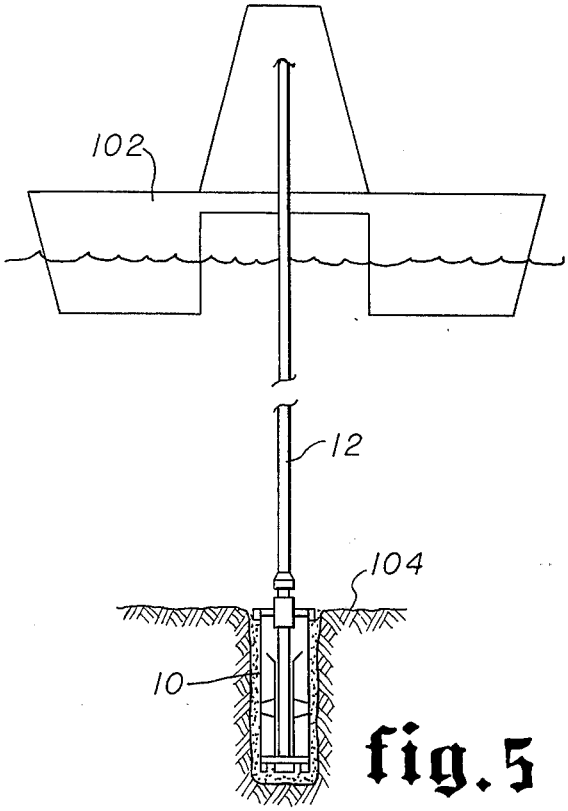
FIG. 5 is a schematic view of the cementing of the anchor in the bore hole.

In cementing as shown in FIG. 5, a quantity of jel mud is initially spotted in the bore and then cement is pumped through the drill string 12 to initially fill the annular space around the anchor assembly 10. Then as the drill string is withdrawn so that its lower end is above the mouth 32 of landing tube 30, the flow of cement is continued to fill the interior of anchor assembly 10.

Figure 6:
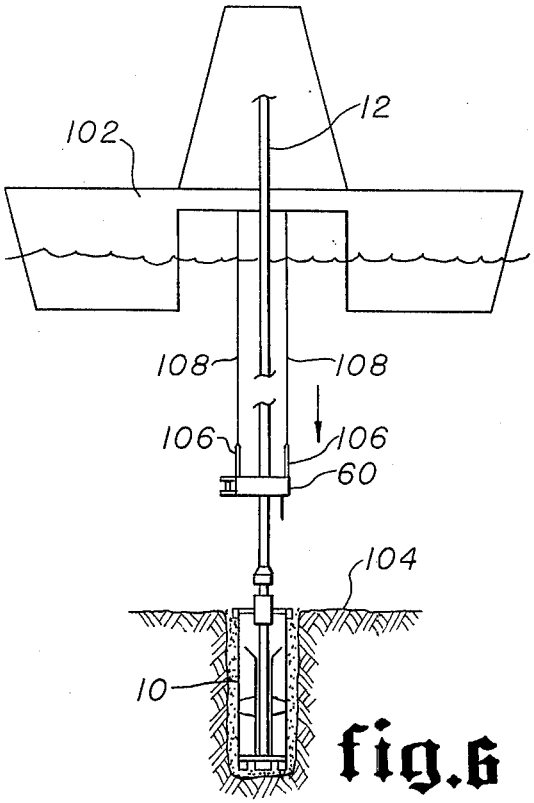
FIG. 6 is a schematic view of the lowering of the swivel.
Figure 7:
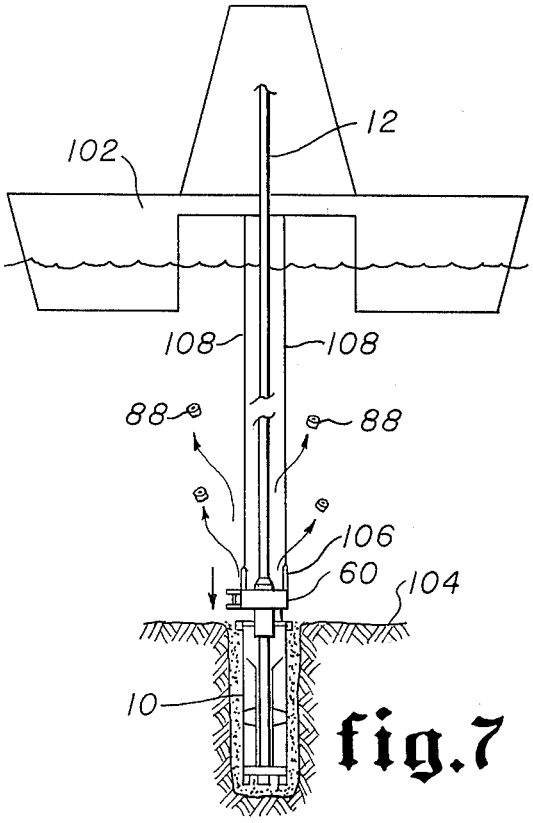
FIG. 7 is a schematic view of the release of swivel locking indicators.
Figure 8:
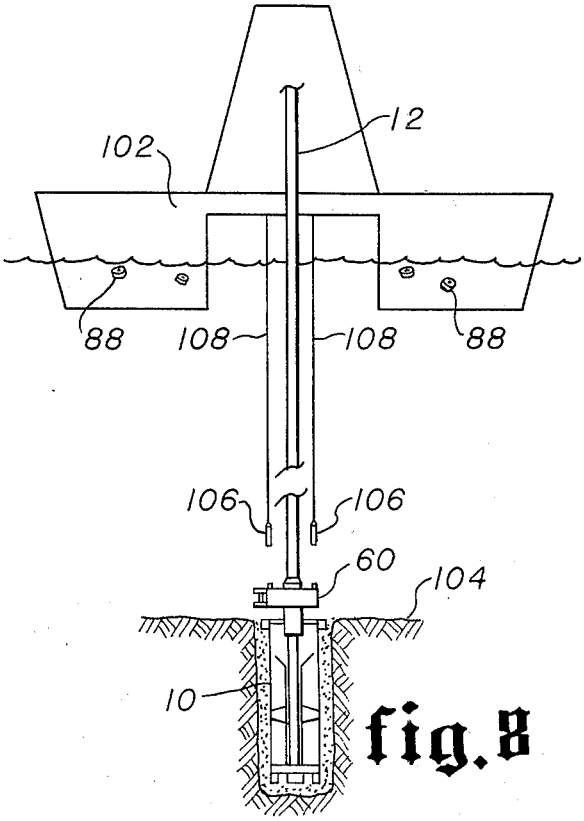
FIG. 8 is a schematic view of the release of the swivel wire line connectors for recovery.

The swivel assembly 60 is placed over the upper end of the drill string 12 and is supported by the releasable wireline connections 106 as it is lowered on wire lines 108 over drill string 12 as shown in FIG. 6. When swivel assembly 60 moves onto neck 42, the latch dogs 76 are forced upwardly until they are opposite groove 44 when they are forced into engagement therein to lock the swivel assembly 60 to the anchor assembly 10. As swivel assembly 60 locks to neck 42, the rods 94 engage the upper closure plate 40 and force the support ring 100, the markers 88 and the locking ring 92 upwardly until the locking ring 92 releases. Thereafter, as shown in FIG. 7, the markers 88 being buoyant and brightly colored rise to the surface where they are readily seen to confirm the locking of the swivel assembly 60 to the anchor assembly 10. Once the markers 88 are noted, the wireline connections 106 to the swivel assembly 60 are released and recovered.

As mentioned above, a particular advantage of the anchor of the present invention is that for its size and weight it is much easier to handle by virtue of its buoyancy in water which reduces its weight in water. Further, by providing a separate swivel assembly which is secured to the anchor assembly after it is set in cement, the swivel and its connecting anchor line are not attached during rotation of the tubing and anchor assembly for drilling the bore hole. Drilling with such anchor lines attached almost always will cause the anchor line to become fouled and limit drilling effectiveness or render the swivel inoperative or nonrotatable. The anchor of the present invention includes an anchor assembly and a swivel assembly which are easy to handle during setting of the anchor.

As has been explained, the improved anchor assembly of the present invention is much easier handled for its size and weight than prior anchor assemblies because the portion of the drill string extending therethrough is sealed therein to prevent entry of water therein until the anchor is set. Also, the present invention provides an improved anchor assembly and swivel assembly which are easy to set, provide an indication of locking of the latches at the surface and assure the anchor buoyancy is available until it is desired to cement the anchor in place. The improved method of the present invention allows for the simple handling of large, heavy anchor assmblies and the separation of the swivel assembly after cementing of the anchor in place in its bore hole.

What is claimed is:

1. The method of setting an anchor from a vessel floating in water, including the steps of suspending below the vessel an anchor assembly having cutters on the lower end thereof and with a portion of a drill string operatively connected to said anchor assembly, said drill string portion being connected to rotate said anchor assembly when rotated in one direction, to release therefrom when rotated in the opposite direction and sealing within said anchor assembly to render it watertight and buoyant when operatively connected thereto, connecting additional lengths of drill string to the drill string portion while lowering the anchor assembly and drill string in the water, rotating the drill string in said one direction of rotate the anchor assembly when the anchor assembly is in contact with the bottom to form a bore hole into which the anchor assembly is lowered as it is formed, and flowing cement through the drill string to cement the anchor assembly within the bore hole.

2. The method according to claim 1, including the steps of lowering a swivel asembly in surrounding relation to the drill string and with an anchor line secured to said swivel assembly to secure said swivel assembly to anchor assembly, and releasing buoyant markers to the surface indicating the securing of the swivel assembly to the anchor assembly.

3. The method according to claim 2, wherein said step of lowering said swivel assembly is accomplished with wire lines and including the step of releasing said wire lines from said swivel assembly after said swivel assembly has been secured to said anchor assembly.

4. The method according to claim 1, including the steps of recovering said drill string by rotating said drill string in said other direction to release it from said anchor assembly and raising said drill string onto said vessel.

5. An anchor comprising, a tubular shell, a section of drill string, closures secured to each end of said tubular shell to form an anchor assembly, cutters supported on one of said closures, the other of said closures having an opening therethrough and means for defining a sealing surface within said opening whereby the insertion of said drill string section therein provides a sealing engagement with said surface, means for connecting said drill string section to said anchor assembly whereby rotation of said drill string section in one direction rotates the anchor assembly for drilling and rotation of said drill string section in the opposite direction releases said drill string section connection to the anchor assembly, said anchor assembly coacting with said drill string section when said drill string section is connected therein to render said anchor assembly watertight to have sufficient buoyancy for simple and easy handling of said anchor assembly in the water.

6. An anchor according to claim 5, wherein said connecting means includes a neck secured to the top one of said closures, said neck having means for securing said drill string section therein and means for sealing around said drill string section to maintain the watertight integrity of said anchor assembly.

7. An anchor according to claim 6, including a landing tube secured to the lower one of said closures for receiving the lower end of said drill string section secured within said neck.

8. An anchor comprising a tubular shell, a section of drill string, closures secured to each end of said tubular shell to form an anchor assembly, cutters supported on one of said closures, the other of said closures having an opening therethrough with a sealing surface defined within said opening whereby the insertion of said drill string section provides a sealing engagement with said surface, means for connecting said drill string section to said anchor assembly whereby rotation of said drill string section in one direction rotates the anchor assembly for drilling and rotation of said drill string section in the opposite direction releases said drill string section connection to the anchor assmbly, said anchor assembly coacting with said drill string section when said drill string section is connected therein to render said anchor assembly watertight to have sufficient buoyancy for simple and easy handling of said anchor assembly in the water, said connecting means including, a neck secured to the top one of said closures, said neck having means for securing said drill string section therein and means for sealing around said drill string section to maintain the watertight integrity of said anchor assembly, said neck including an annular groove around its exterior, and a swivel assembly being annular in shape for lowering in surrounding relation to said drill string section and having latching means adapted to engage within said annular groove to secure said swivel assembly to said neck.

9. An anchor according to claim 8, including means releasably secured to said swivel assembly for providing an indication at the surface that said swivel assembly has been secured to said neck.

10. An anchor according to claim 9, wherein said indicating means includes a plurality of bouyant markers releasably secured to said swivel assembly and a push rod for each of said markers being sufficiently long to release said markers by engagement with the top one of said closures when said swivel assembly latching means becomes engaged in said annular groove.

11. An anchor according to claim 8, wherein said latching means includes a plurality of latching dogs, a plurality of tapered cams, means mounting said latching dogs with respect to said cams whereby said dogs are maintained in sliding contact with said cams, and means biasing said dogs inwardly whereby when they register with said annular groove in said neck they are moved into latching engagement with said groove.

12. An anchor comprising a tubular shell, a section of drill string, an upper closure secured to one end of said shell and defining a central opening therethrough, a neck secured within the central opening of said upper closure and projecting thereabove, said neck having an extenal circumferential groove defined therein, a lower closure secured to the opposite end of said shell, a plurality of cutters secured to the exterior of the lower closure whereby rotation of said tubular shell with said cutters engaging a formation causes said cutters to drill into said formation, said neck having a bore therethrough, means for releasably connecting to said drill string section, and means for sealing around said drill string section connected therein, a landing tube secured within said shell to the interior of said lower closure and adapted to receive said drill string section therein, said lower closure having an opening therethrough in communication with the interior of said landing tube, said closures, said shell and said drill string section when received therein forming a watertight structure having a buoyancy which at least partially offsets the weight of said structure when it is submerged in water, a swivel having a pin to which an anchor line may be attached, means on said swivel adapted to engage within said groove in said neck for securing said swivel to said structure, and means releasably attached to said swivel and being released upon said swivel being secured to said structure to signal the securing of the swivel to said structure.

* * * * *